United States Patent [19]

Metzger

[11] Patent Number: 4,827,590

[45] Date of Patent: May 9, 1989

[54] METHOD OF MAKING OF HEADER FOR AUTOMOTIVE AIR CONDITIONER EVAPORATOR

[76] Inventor: Frederick W. Metzger, 6075 Pelican Bay Blvd., Dorchester 402, Naples, Fla. 33963

[21] Appl. No.: 179,400

[22] Filed: Apr. 8, 1988

[51] Int. Cl.[4] ..... B21D 53/00

[52] U.S. Cl. ..... 29/157.4; 72/316; 72/370; 72/398

[58] Field of Search ..... 29/157.4, 559, DIG. 41; 72/367, 370, 398, 402, 403, 316; 165/173

[56] References Cited

U.S. PATENT DOCUMENTS

| | | | |
|---|---|---|---|
| 745,254 | 11/1903 | Sneddon | 29/157.4 |
| 1,699,688 | 1/1929 | Cross | 29/157.4 |
| 3,889,511 | 6/1975 | Bayle | 72/370 |
| 3,977,227 | 8/1976 | Noble | 72/367 |
| 4,722,216 | 2/1988 | Fencl | 72/370 |

*Primary Examiner*—Howard N. Goldberg
*Assistant Examiner*—Irene Cuda
*Attorney, Agent, or Firm*—Stonebraker, Shepard & Stephens

[57] ABSTRACT

A header for an automotive air conditioner evaporator is made from a cut-off length of a cylindrical aluminum tube (10), one end of which is clamped on a cylindrical arbor (11) so that a header region (20) of the tube can be pressed into a generally rectangular shape in a channel-shaped forming tool (15). While confined within the forming tool, a forming arbor (25) having a generally rectangular cross-sectional shape is pressed into header region (20) to conform the header region to the shape of forming arbor (25) and the confines of forming tool (15).

5 Claims, 2 Drawing Sheets

METHOD OF MAKING OF HEADER FOR AUTOMOTIVE AIR CONDITIONER EVAPORATOR

BACKGROUND

A header for an automotive air conditioner evaporator requires a generally rectangular in cross section header region having openings cut to receive lateral tubes, a plug closing one end, and a cylindrical opening for connection to an input or output tube at the other end. Such a header was initially made from an aluminum extrusion that accurately conformed to the generally rectangular cross-sectional shape of the header region, and the cylindrical end of the header was separately formed of aluminum and brazed onto the rectangular end of the extrusion. Now, for a cheaper and better header than the brazing operation can produce, the cylindrical end is formed by expanding and rounding an end region of the rectangular extrusion. This requires several hits or presses with different shaped tools, against both inside and outside surfaces, to form the rectangular extrusion into a cylindrical end. The result is a rough and irregular header disfigured by tool marks and priced relatively high to cover the cost of the several stamping operations required.

I have found a simpler, cheaper, and more effective way of making such a header for an automotive air conditioner evaporator. My method of making this part forms it rapidly from a single piece of aluminum tubing in a simple forming operation that produces a smoother and better looking part meeting all the dimensional requirements. Equally important for automotive purposes, my way of making the part can produce it at a lower cost than either of the previous ways.

SUMMARY OF THE INVENTION

My method of making a header for an automotive air conditioner evaporator begins by cutting a suitable length from a cylindrical aluminum tube, selected for having a wall with a circumferential length long enough to extend around the generally rectangular shape required for the header region. I press one end of the tube onto a cylindrical arbor and clamp the tube in place on the arbor to form the cylindrical end of the header. The rest of the tube extends from the arbor into a channel-shaped forming tool having a bottom wall and a pair of opposed side walls. I then press the header region of the tube into the forming tool against the bottom wall and in between the side walls to form the header region approximately to the generally rectangular cross-sectional shape that is required. While confining the header region within the forming tool, I press a generally rectangular in cross section forming arbor into the header region for conforming the header region to a space between the forming arbor and the forming tool. This brings the header region accurately to the required dimensions, and it produces a drawn region between the clamped cylindrical end and the header region. The drawn region slopes from the cylindrical region to the header region and is stretched and drawn so that the wall in the sloping region is thinner than the wall in the header region and the cylindrical region. The wall in the sloping region also is smoothly curved from the cylindrical region to the header region. I then withdraw the forming arbor from the header region and remove the part from the forming tool and the clamping arbor and finish the part by cutting the necessary holes in the header region and brazing a plug into the closed end of the header region.

DRAWINGS

DETAILED DESCRIPTION

Instead of making a header for an automotive air conditioner evaporator from an aluminum extrusion formed in the required rectangular shape of the header region of the part, I begin with a cylindrical aluminum tube, which is available in a variety of diameters and wall thicknesses. I select a tube with a wall having the thickness required for the rectangular header region, and having a circumference long enough to extend around the generally rectangular extent of the header region.

Figure 1:
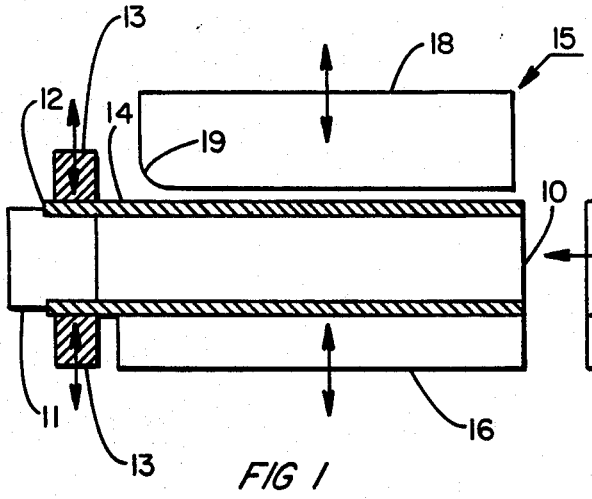
FIG. 1 is a partially cross-sectioned, schematic view of a forming tool in which a cylindrical tube is clamped for forming a header for an automotive air conditioner evaporator, according to my invention.
Figure 2:
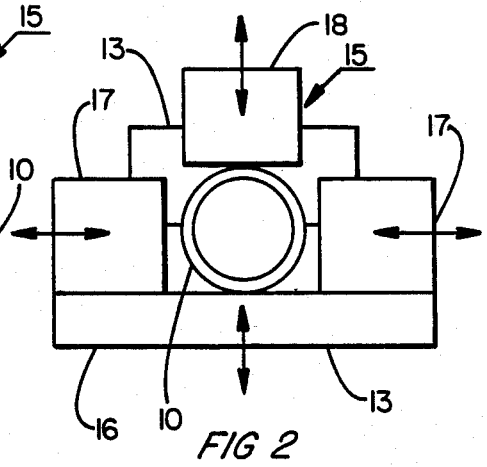
FIG. 2 is an end view of the forming tool of FIG. 1, with the tube positioned for forming.

I cut such a tube 10 into a suitable length for forming the header; and as shown in FIG. 1, I press an open end 12 of tube 10 onto a cylindrical arbor 11 and clamp tube end 12 firmly onto arbor 11 by means of movable clamp jaws 13. In the clamped position, tube 10 extends from arbor 11 into a forming tool 15 where a header region 20 of tube 10 will be given the generally rectangular shape that is required.

Figure 3:
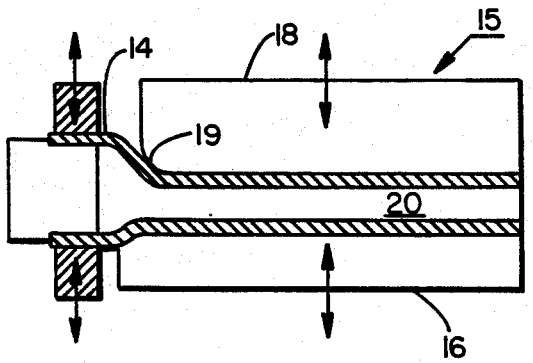
FIG. 3 is a partially cross-sectioned, schematic view, similar to the view of FIG. 1, and showing the forming of a generally rectangular header region on the clamped tube.

Forming tool 15 includes a bottom or support surface 16 extending axially along tube 10 and a pair of side walls 17 that are preferably movable together and apart. Bottom support 16 will form the bottom of header region 20, and side walls 17 will form side walls of header region 20. To form the top wall of header region 20, forming tool 15 includes a pressing tool 18 arranged above the forming channel between side walls 17 and movable downward toward channel bottom 16. When pressing tool 18 moves down to the bottom of its pressing stroke, it partially flattens tube 10 to an approximately rectangular cross-sectional shape, as shown in FIGS. 3 and 4.

As this occurs, a region 14 of tube 10 that slopes downward from clamped cylindrical end 12 is drawn and stretched. This leaves wall 14 thinner than the original thickness of the wall of tube 10 and thinner than the clamped cylindrical region 12 or the generally rectangular shaped header region 20. Presser tool 18 has a rounded lower edge 19 confronting cylindrical end region 12 to help the draw occur in wall region 14 and to round wall 14 as it merges with header region 20.

Figure 4:
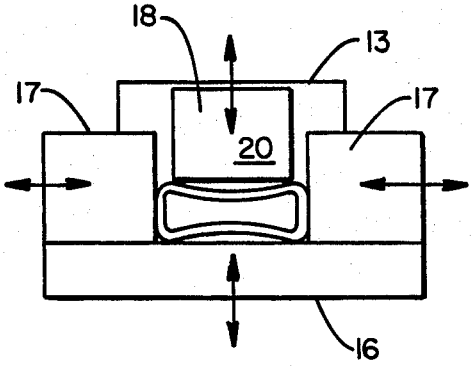
FIG. 4 is an end view of the forming tool of FIG. 3, showing the header region partially formed on the clamped tube.
Figure 5:
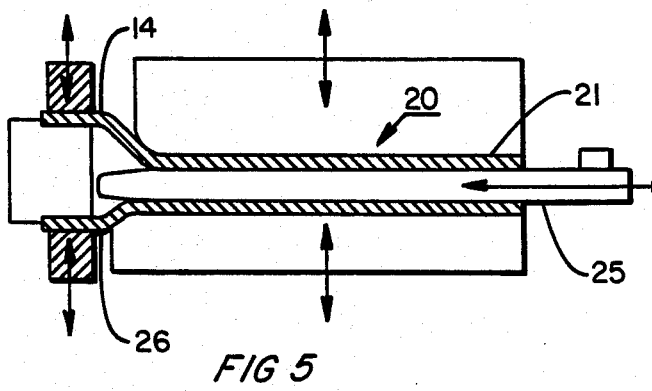
FIG. 5 is a partially cutaway, schematic view, similar to the view of FIG. 3, and showing a forming arbor inserted into the clamped tube to complete the forming of the header region.
Figure 6:
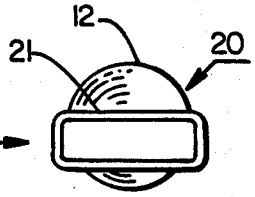
FIG. 6 is a view from the header region end of the formed header removed from the forming tool.

As best shown in FIG. 4, the top and bottom walls of header region 20 are slightly concave, after tube 10 is pressed by tool 18. To correct this, and to bring header region 20 to its required dimensions, I press a forming arbor 25 into header region 20 while pressing tool 18 remains at the bottom of its stroke. Forming arbor 25 is generally rectangular in cross section and has the specific dimensions desired for the inside surface of header region 20. Its forward end 26 is slightly tapered to facilitate insertion into the open end of header region 20. The dimensions required for the outside surface of header region 20 are set by bottom support 16, side walls 17, and the bottom of presser tool 18 in its lowermost position. This makes the space available between forming arbor 25 and forming tool 15 precisely match the inside and outside dimensions desired for header region 20, so that the aluminum wall material in this space has no escape and conforms accurately to the required shape. In practice, the upper wall 21 of header region 20 between the top of forming arbor 25 and the bottom of presser tool 18 is slightly arched or convex, and this shape is achieved by making the bottom of presser tool 18 slightly concave and the top of forming arbor 25 slightly convex.

Header region 20 is also offset from clamped cylindrical end region 12, rather than being symmetrical with a diameter of cylindrical region 12. The amount of offset can vary according to the customer's desires; and the greater the offset, the greater the draw or stretch applied to tube wall 14.

Figure 7:
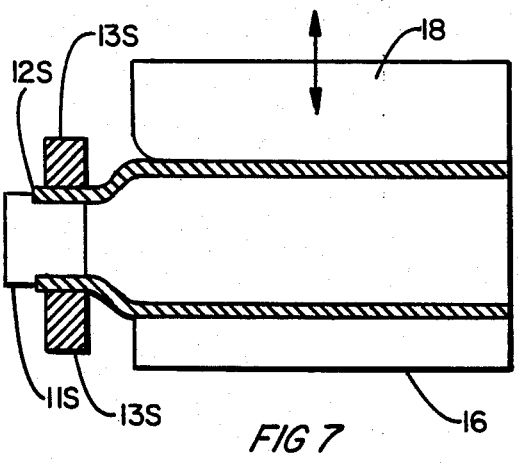
FIG. 7 is a partially cross-sectioned, schematic view, similar to the view of FIG. 1, showing an alternative way of making a header for an automotive air conditioner evaporator by using a necked down tube clamped in an arbor and disposed in a forming tool.
Figure 8:
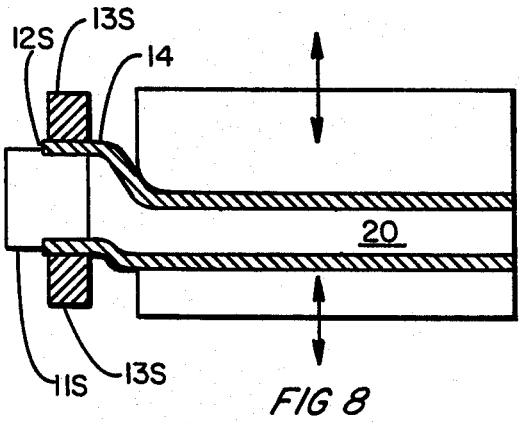
FIG. 8 is a partially cross-sectioned, schematic view, similar to the view of FIG. 3, showing the forming of a header region in the necked down and clamped tube.
Figure 9:
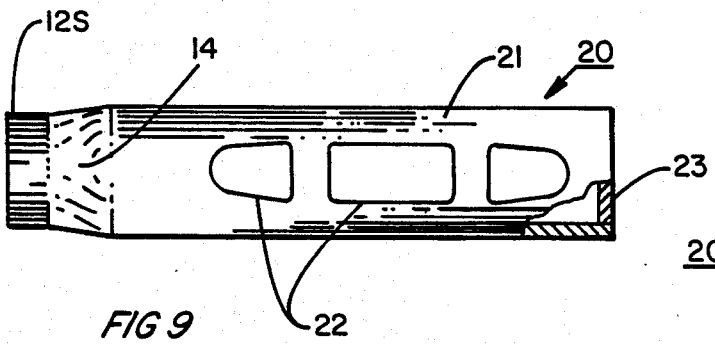
FIG. 9 is a partially cutaway plan view of a completed header, having openings cut in a header region, and an end plug brazed in place.

FIGS. 7 and 8 show the forming of an alternative embodiment of a header for an automotive air conditioner evaporator having a smaller diameter cylindrical region 12S. This is formed by necking down end region 12S of tube 10 to a smaller diameter, as best shown in FIG. 7, before pressing necked down region 12S onto arbor 11S and clamping it in place with clamp jaws 13S. The rest of the forming operation proceeds as explained above and as shown in FIG. 8. The offset of header region 20 from cylindrical region 12S is also slightly different, as shown by a comparison of FIGS. 3 and 8.

Figure 10:
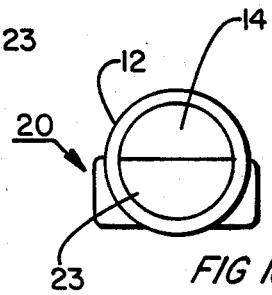
FIG. 10 is an elevational view of the cylindrical end of the completed header of FIG. 9.

Completing the header requires two more steps that are both generally known. One is to cut openings 22 in top wall 21 of header region 20, and the other is to braze an end plug 23 in place to close one end of header region 20. The completed part, as viewed from cylindrical end 12, is shown in FIG. 10.

My way of forming a header for an automotive air conditioner evaporator makes a smoothly formed and good looking part with a wall that smoothly curves through the transition between cylindrical end 12 and header region 20. The part can also be made at a lower cost than either previous method of fabricating. By starting with inexpensive and readily available cylindrical aluminum tubing, I economize on the material used to form the part. Then the forming operation requires only clamping and holding one end of the tube, pressing down with presser tool 18, and pressing in with forming arbor 25, to complete the shaping of the part. This is fast and simple and forms the part accurately at a low cost.

In a forming tool 15 made for production, side walls 17 are preferably movable together and apart to facilitate releasing the finished part from the tool. Bottom support 16 can also be adjustable vertically, depending on th offset required between cylindrical region 12 and header region 20. The pressing of tube 10 onto arbor 11, bringing clamp jaws 13 into clamping position, and otherwise opening and closing forming tool 15 would all be powered and automated, as is generally known in the forming tool art. The end result is a header that is accurately dimensioned and efficiently made so that it can be sold to an automotive manufacturer at a lower cost than has previously been possible.

I claim:

1. A method of making a header for an automotive air conditioner evaporator, said header having a header region generally rectangular in cross section and closed at one end and having a cylindrical open region proximate to said header region opposite said closed end, said method comprising:

a. cutting a suitable length from a cylindrical aluminum tube;

b. pressing an open end region of said tube onto a cylindrical arbor and clamping said open end region of said tube on said arbor so that the clamped region of said tube serves as said cylindrical open region and a header region of said tube extends from said arbor into a channel-shaped forming tool having a bottom wall and a pair of opposed side walls;

c. pressing said header region of said tube into said forming tool against said bottom wall and in between said side walls to form said header region approximately to said generally rectangular cross-sectional shape; and d. after forming said header region into a generally rectangular cross section, and while still confining said header region within said forming tool, pressing a generally rectangular in cross section forming arbor into said header region for conforming said header region to the shape of the forming tool.

2. The method of claim 1 including forming said header region to be offset from said clamped cylindrical open region.

3. The method of claim 1 including necking down said open end region of said tube to a smaller diameter before clamping said necked down open end on said arbor.

4. The method of claim 1 including selecting said tube to provide a circumferential wall long enough to extend around said generally rectangular cross-sectional shape of said header region.

5. The method of claim 1 including dimensioning the space between said forming arbor and said forming tool to equal the wall space between inside and outside surfaces of said header region.

* * * * *